US009421609B2

(12) United States Patent
Yamaoka et al.

(10) Patent No.: US 9,421,609 B2
(45) Date of Patent: Aug. 23, 2016

(54) METHOD FOR MANUFACTURING ROTOR

(71) Applicant: DENSO CORPORATION, Kariya, Aichi (JP)

(72) Inventors: Tadashi Yamaoka, Okazaki (JP); Yuji Hirata, Ichinomiya (JP); Takashi Aoyama, Toyota (JP); Hiroshisa Sasaki, Toyota (JP)

(73) Assignee: DENSO CORPORATION, Kariya (JP)

( * ) Notice: Subject to any disclaimer, the term of this patent is extended or adjusted under 35 U.S.C. 154(b) by 25 days.

(21) Appl. No.: 14/560,328

(22) Filed: Dec. 4, 2014

(65) Prior Publication Data

US 2015/0151358 A1 Jun. 4, 2015

(30) Foreign Application Priority Data

Apr. 12, 2013 (JP) ..... 2013-251323

(51) Int. Cl.

| | |
|---|---|
| ***B22D 19/00*** | (2006.01) |
| ***B22D 29/00*** | (2006.01) |
| ***B22C 9/22*** | (2006.01) |
| ***B22C 9/08*** | (2006.01) |
| ***B22D 19/04*** | (2006.01) |

(52) U.S. Cl.

CPC ..... *B22D 19/0054* (2013.01); *B22C 9/08* (2013.01); *B22C 9/22* (2013.01); *B22D 19/04* (2013.01); *B22D 29/00* (2013.01)

(58) Field of Classification Search

None

See application file for complete search history.

(56) References Cited

U.S. PATENT DOCUMENTS 1,360,484 A * 11/1920 Wiard ..... B22D 19/0054 164/109
1,610,816 A * 12/1926 Rutherford ..... H02K 15/0012 29/598
1,735,049 A * 11/1929 Lester ..... B22D 19/0054 164/262
2,192,787 A * 3/1940 Elsey ..... B22D 19/0054 164/333
2,392,802 A * 1/1946 Anderson ..... B22D 19/0054 310/211
3,256,572 A * 6/1966 Fisher ..... B22D 17/2076 164/265
2005/0067130 A1* 3/2005 Ramirez ..... B22D 13/04 164/103
2011/0024073 A1 2/2011 Kamiyama et al.

FOREIGN PATENT DOCUMENTS

JP S60-020762 A 2/1985
JP S60-204244 A 10/1985

(Continued)

OTHER PUBLICATIONS

Sep. 29, 2015 Office Action issued in Japanese Patent Application No. 2013-251323.

*Primary Examiner* — Kevin E Yoon
*Assistant Examiner* — Jacky Yuen
(74) *Attorney, Agent, or Firm* — Oliff PLC

(57) ABSTRACT

In a setting step, a plurality of steel plates configuring a rotor core stacked in an axial direction of a rotor is set in a predetermined position in a mold that is capable of being opened and closed by relative movement in the axial direction. In a casting step, molten metal is fed into a molten metal introduction passage to form a conductive member of the rotor. The molten metal introduction passage has a ring-shaped gate that is opened so as to oppose one axial end surface of the steel plates set in the mold. In a cutoff step, the molten metal is cut off in the molten metal introduction passage so as to be separated into a gate side and a molten metal introduction opening side. In a mold-releasing step, the mold is opened such that a casting configuring the rotor is removed from the mold.

15 Claims, 13 Drawing Sheets

(56) References Cited

FOREIGN PATENT DOCUMENTS

| | | | | |
|---|---|---|---|---|
| JP | S62-051966 | U | | 3/1987 |
| JP | S63-073852 | A | | 4/1988 |
| JP | H03-22852 | A | | 1/1991 |
| JP | 2529654 | B2 | * | 8/1996 |
| JP | 2002-369471 | A | | 12/2002 |
| JP | 2005-012907 | A | | 1/2005 |
| JP | 2005-514897 | A | | 5/2005 |
| JP | 2009-254049 | A | | 10/2009 |
| JP | 2009-284655 | A | | 12/2009 |

* cited by examiner

METHOD FOR MANUFACTURING ROTOR

CROSS-REFERENCE TO RELATED APPLICATION

This application is based on and claims the benefit of priority from Japanese Patent Application No. 2013-251323, filed Dec. 4, 2013, the disclosure of which is incorporated herein in its entirety by reference.

BACKGROUND

1. Technical Field

The present invention relates to a method for manufacturing a rotor of a rotating electric machine that is, for example, mounted in a vehicle, and used as a motor or a generator.

2. Related Art

A motor with a squirrel-cage rotor is known in related art as a type of rotating electric machine used to be mounted in a vehicle or the like. The squirrel-cage rotor has a squirrel-cage structure with conductors having both axial ends that are short-circuited together. The squirrel-cage rotor includes a rotor core and a conductive member.

The rotor core is composed of a plurality of steel plates that are stacked in an axial direction of the rotor. The plurality of steel plates have a center shaft hole and a plurality of through holes. The center shaft hole passes through the steel plates in the axial direction. The plurality of through holes pass through the steel plates in the axial direction and are arrayed in a circumferential direction of the rotor.

The conductive member has a pair of end rings and a plurality of connection bars. The pair of end rings are disposed on both axial ends of the rotor core in the axial direction. The plurality of connection bars connect the pair of end rings through the through holes. The conductive member is integrally formed by casting.

A method for manufacturing a squirrel-cage rotor in related art such as that described above involves a setting step and a casting step. At the setting step, a plurality of steel plates configuring a rotor are stacked in an axial direction of the rotor and set in a predetermined position in a mold. At the casting step, molten metal is fed into a molten metal introduction passage, thereby forming a conductive member. The molten metal introduction passage has a gate that opens onto one axial end side of the stacked steel plates that are set in the mold.

In this method, as shown in FIG. 24, the molten metal is introduced from a gate 124*a* of a molten metal introduction passage 124 into an end ring cavity 123*a* on one axial end side of the set stacked steel plates. The introduced molten metal then flows into the plurality of through holes 113 provided in the stacked steel plates 111*a*, in the order from a through hole 113*a*, which is located at a position nearest to the gate 124*a* in a radial direction D2, to a through hole 113*b* which is located at a position furthest from the gate 124*a* in the radial direction D2. Therefore, the molten metal flowing into the through hole 113*a* reaches an end ring cavity 123*b* on the other axial end side of the set stacked steel plates first.

The molten metal flowing from the through hole 113*a* then reaches, via the other axial end side, the through hole 113*b* ahead of the molten metal that flows into the through hole 113*b* from the one axial end side. As a result, the flow of molten metal from the other axial end side merges with the flow of molten metal from the one axial end side. A problem occurs in that a cold shut may be thereby formed.

In addition, as shown in section A in FIG. 25, a problem also occurs in that a blowhole may be formed as a result of air within the mold becoming trapped in a connection bar 117 that is formed within the through hole 113*b*. When the blowhole and the above-described cold shut are formed in this way, properties, such as strength and conductivity, of the conductive member are significantly affected.

Therefore, JP-A-563-73852 proposes improving the balance of flow of the molten metal that flows through the through holes in the rotor core. The improvement is made by a cylindrical ring being provided at the axial end portion of the pair of end rings disposed on both axial end sides of the rotor core. The cylindrical ring has a radial-direction thickness that is thinner than the end ring.

In addition, JP-A-S60-204244 proposes a technique for improving the balance of flow of the molten metal that flows through the through holes in the rotor core. The technique involves providing a plurality of gates in the circumferential direction. The gates each open into the end ring cavity on the one axial end side of the stacked steel plates that are set in the mold.

However, in the case of above-described JP-A-S63-073852, a casting defect caused by solidification shrinkage of the molten metal easily occurs in areas in which the thickness of the end ring is increased. In addition, when a cutoff process is performed to ensure product shape after completion of the casting step, a problem occurs in that the casting defect is exposed on the surface.

On the other hand, in the case of above-described JP-A-S60-204244, the plurality of gates that open into the end ring cavity are evenly disposed in the circumferential direction. However, there is a limit to the number of gates that can be disposed. Although the balance of flow is improved compared to when the molten metal flows in from the end portion of the end ring as in the past, described above, the flow is not completely even.

Furthermore, in the case of JP-A-S60-204244, when the gates are cut off after completion of the casting step, tensile stress between the gate portion and the product part is used to cut off the gates. Therefore, a large load is also applied to the product part. The gate portion is required to be made smaller to prevent the large load from being applied to the product part. However, when the gates are made smaller, the fluidity of the molten metal becomes extremely poor. A problem occurs in that casting defects easily occur because casting pressure becomes difficult to apply.

SUMMARY

It is thus desired to provide a method for manufacturing a rotor in which the fluidity of molten metal is improved and the occurrence of casting defects can be suppressed.

An exemplary embodiment of the present disclosure provides present invention that has been achieved to solve the above-described problems is a method for manufacturing a rotor.

The rotor includes a rotor core and a conductive member. The rotor core is composed of a plurality of steel plates that are stacked in an axial direction of the rotor. The steel plates have a center shaft hole and a plurality of through holes. The center shaft hole passes through the steel plates in the axial direction. The plurality of through holes pass through the steel plates in the axial direction and are arrayed in a circumferential direction of the rotor. The conductive member has a pair of end rings and a plurality of connection bars. The pair of end rings are disposed on both axial ends of the rotor core. The plurality of connection bars connect the pair of end rings through the through holes. The conductive member is integrally formed by casting.

The method for manufacturing a rotor includes a setting step, a casting step, a cutoff step, and a mold-releasing step. The setting step includes setting, in a predetermined position in a mold, the plurality of steel plates configuring the rotor core stacked in the axial direction. The mold can be opened and closed by relative movement in the axial direction. The casting step includes feeding molten metal into a molten metal introduction passage such that the conductive member is formed. The molten metal introduction passage has a ring-shaped gate that is opened so as to oppose one axial end surface of the plurality of steel plates set in the mold. The cutoff step includes cutting off the molten metal in the molten metal introduction passage so as to be separated into a gate side and a molten metal introduction opening side. The mold-releasing step includes opening the mold such that a casting configuring the rotor is removed from the mold.

In the method for manufacturing a rotor of exemplary embodiment, the mold used at the casting step is provided with the molten metal introduction passage that has the ring-shaped gate. The gate is opened so as to oppose the one axial end surface of the plurality of steel plates set in the mold. Therefore, the molten metal that has been fed into the molten metal introduction passage can be sent to flow evenly in a radiating direction from the ring-shaped gate.

As a result, the molten metal can be sent into a cavity in the mold so as to flow evenly in the circumferential direction. The molten metal can therefore flow into each through hole in the plurality of steel plates set in the mold, in a well-balanced manner. As a result, fluidity of the molten metal is improved. The occurrence of casting defects, such as blowholes, can be suppressed.

In the present disclosure, a well-known technique, such as die casting, gravity casting, or sand-mold casting, can be used at the casting step. In addition, the material of the conductive member formed by casting can be, for example, aluminum, copper, zinc, magnesium, or a combination of two or more of such materials.

DESCRIPTION OF THE EMBODIMENTS

Figure 1:
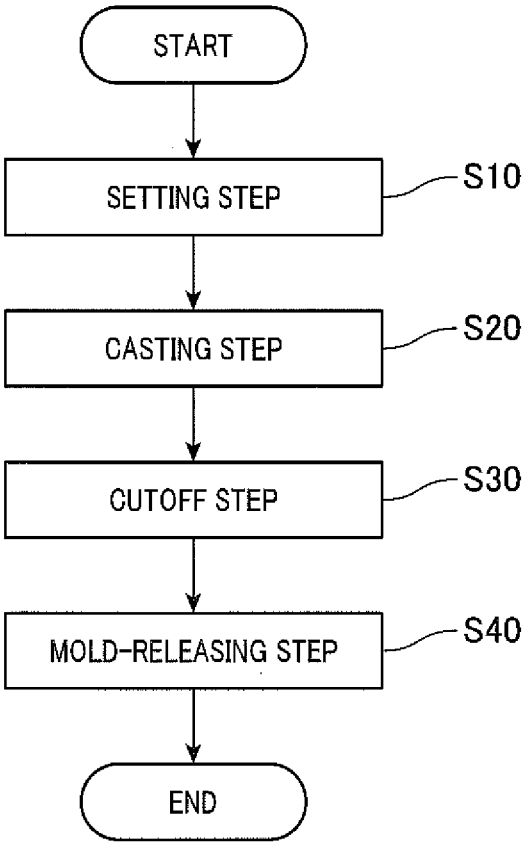
FIG. 1 is a flowchart of a method for manufacturing a rotor according to a first embodiment.
Figure 2:
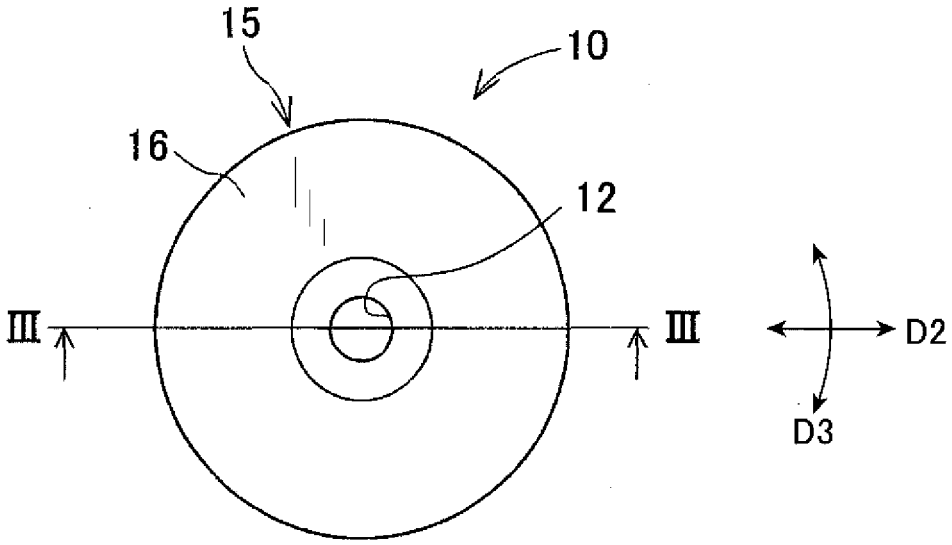
FIG. 2 is a planar view of the rotor manufactured by the method for manufacturing a rotor according to the first embodiment.
Figure 3:
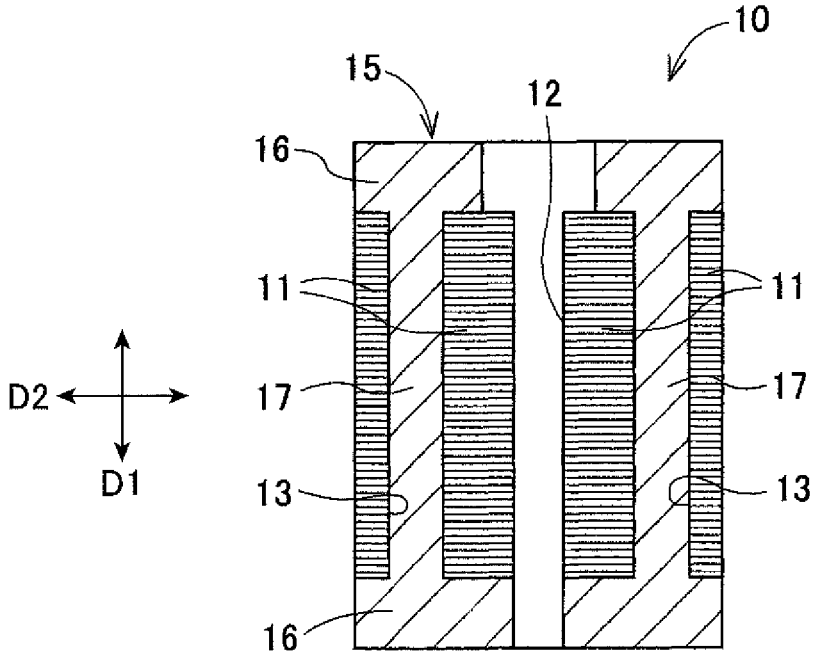
FIG. 3 is a cross-sectional view taken along III-III in FIG. 2.
Figure 4:
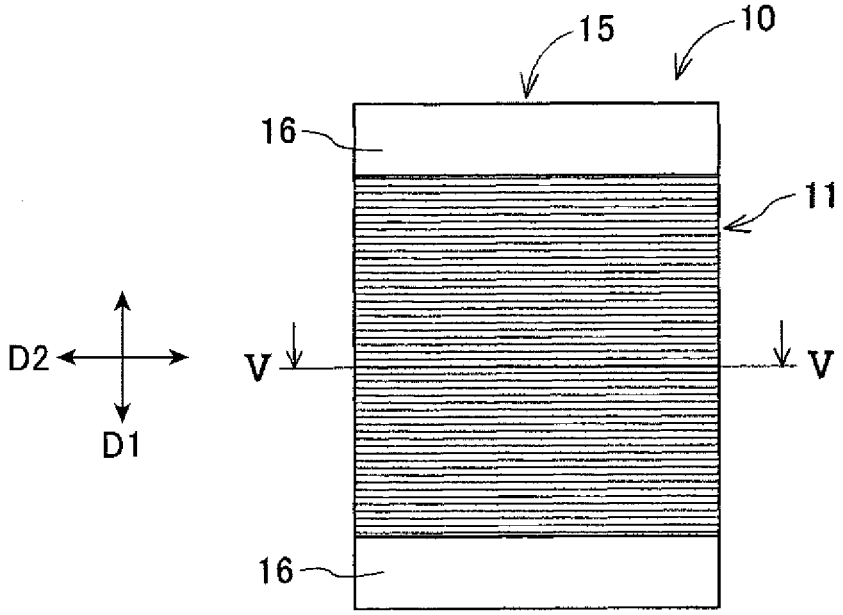
FIG. 4 is a front view of the rotor manufactured by the method for manufacturing a rotor according to the first embodiment.
Figure 5:
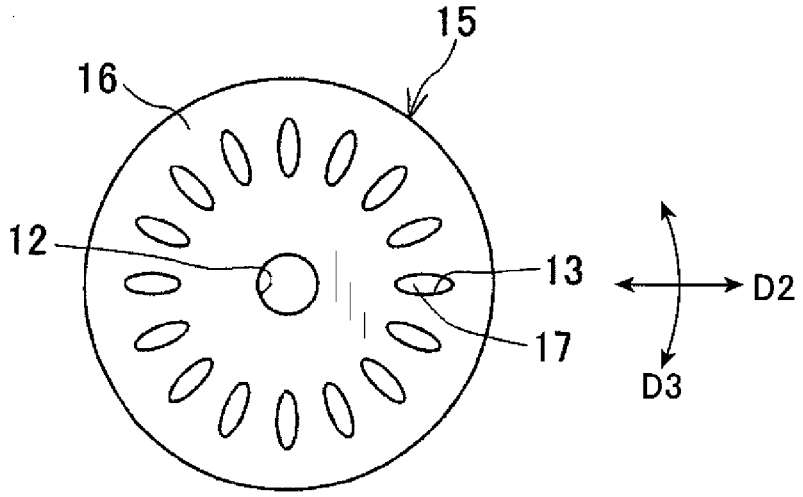
FIG. 5 is a cross-sectional view taken along V-V in FIG. 4.

A method and an apparatus for manufacturing a rotor according to an embodiment of the present disclosure will hereinafter be described in detail with reference to the drawings.

First Embodiment

The method for manufacturing a rotor according to the present embodiment will be described with reference to FIGS. 1 to 14. First, a rotor 10 that is manufactured by the manufacturing method according to the present embodiment will be described. The rotor 10 is a squirrel-cage rotor that is mounted in a rotating electric machine (not shown). The rotating electric machine is used as, for example, a squirrel-cage three-phase motor for a vehicle. In the following descriptions, an axial direction, a radial direction, and a circumferential direction of the rotor 10 and an apparatus (including a casting apparatus) for manufacturing the rotor 10 are respectively denoted by D1, D2, and D3.

As shown in FIGS. 2 to 5, the rotor 10 includes a rotor core 11 and a conductive member 15. The rotor core 11 is composed of a plurality of steel plates that are stacked in the axial direction D1. The conductive member 15 has a pair of end rings 16 and a plurality of connection bars 17 (see FIG. 3). The plurality of connection bars 17 connect the two end rings 16. The conductive member 15 is integrally formed by casting.

The rotor core 11 is formed by a plurality of ring plate-shaped steel plates 11*a* being stacked in the axial direction D1. The steel plates 11*a* have a center shaft hole 12 and a plurality (16 according to the present embodiment) through holes 13 (see FIG. 5). The center shaft hole 12 passes through the steel plates 11*a* in the axial direction D1. The plurality of through holes 13 pass through the steel plates 11*a* in the axial direction D1 and are arrayed in the circumferential direction D3.

The pair of end rings 16 configuring the conductive member 15 are disposed on both axial ends of the rotor core 11. The connection bars 17 configuring the conductive member 15 connect the pair of end rings 16 via the through holes 13. According to the present embodiment, 16 connection bars 17 are provided.

Next, the method for manufacturing the rotor 10 according to the present embodiment will be described. The manufacturing method according to the present embodiment manufactures the rotor 10 by aluminum die casting. As shown in the flowchart in FIG. 1, a setting step S10, a casting step S20, a cutoff step S30, and a mold-releasing step S40 are performed in sequence.

Figure 6:
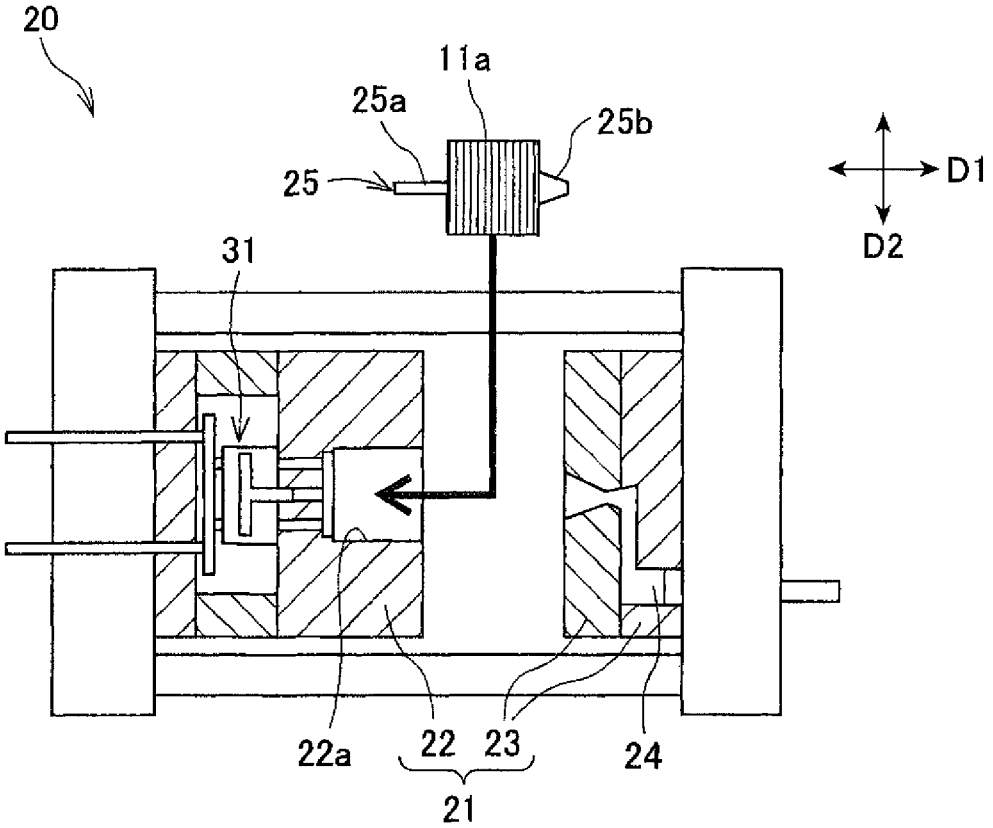
FIG. 6 is an explanatory diagram of a setting step in the method for manufacturing a rotor according to the first embodiment.

At the setting step S10, the plurality of steel plates 11*a* configuring the rotor core 11 are stacked in the axial direction D1 and set in a predetermined position of a mold 21 in a casting apparatus 20 that is used for manufacturing the rotor 10. The mold 21 can be opened and closed by relative movement in the axial direction D1. As shown in FIG. 6, the mold 21 used herein is mounted in the casting apparatus 20. The mold 21 includes a fixed mold 22 and a movable mold 23. The fixed mold 22 has a cavity 22*a* in which the plurality of steel plates 11*a* configuring the rotor core 11 are set. The movable mold 23 is provided so as to be capable of relative movement (approaching and separating) in the axial direction D1 (the left/right direction in FIG. 6) in relation to the fixed mold 22, by a driving unit (not shown).

The movable mold 23 is provided with a molten metal introduction passage 24. The molten metal introduction passage 24 feeds molten metal into the cavity 22*a*. The molten metal introduction passage 24 has a ring-shaped gate 24*a*. The gate 24*a* opens so as to oppose one axial end surface (the right end surface in FIG. 6) of the plurality of steel plates 11*a* set in the cavity 22*a* of the fixed mold 22. The gate 24*a* according to the present embodiment is formed into a ring shape that makes a single continuous circuit in the circumferential direction D3. A cylindrical sloped passage 24*b* is disposed on the gate 24*a* side of the molten metal introduction passage 24. The sloped passage 24*b* is sloped so as to gradually increase in diameter towards the gate 24*a*.

In addition, the plurality of steel plates 11*a* that are set in the cavity 22*a* of the fixed mold 22 are held by a holding pin 25 in a state in which the steel plates 11*a* are stacked in the axial direction D1. The holding pin 25 includes a shaft portion 25*a* and a blocking portion 25*b*. The shaft portion 25*a* is inserted into the center shaft hole 12 of the steel plates 11*a*. The blocking portion 25*b* is disposed on one axial end portion of the shaft portion 25*a*. The blocking portion 25*b* blocks an opening of the center shaft hole 12 on the molten metal feeding side.

Figure 7:
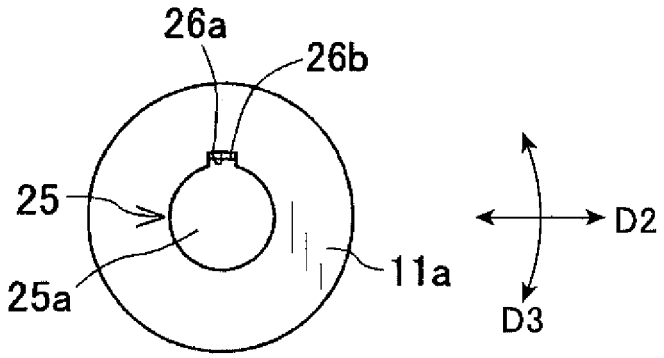
FIG. 7 is a cross-sectional view of stacked steel plates in a direction perpendicular to a shaft, the stacked steel plates being held by a holding pin, at the setting step in the method for manufacturing a rotor according to the first embodiment.

As shown in FIG. 7, a positioning portion is provided in the shaft portion 25*a* of the holding pin 25. The positioning portion performs positioning in a rotation direction (circumferential direction D3) of the plurality of steel plates 11*a* that are fitted onto the shaft portion 25*a*. According to the present embodiment, the positioning portion is composed of an engaging recessing portion 26*a* and an engaging projecting portion 26*b*. The engaging recessing portion 26*a* is provided in the center shaft hole 12 of the steel plates 11*a*. The engaging projecting portion 26*b* is disposed on the outer peripheral surface of the shaft portion 25*a*. The engaging projecting portion 26*b* is capable of engaging with the engaging recessing portion 26*a*. The projecting/recessing relationship between the engaging recessing portion 26*a* and the engaging projecting portion 26*b* may also be reversed.

The blocking portion 25*b* of the holding pin 25 is formed into a circular truncated cone shape. The blocking portion 25*h* gradually decreases in diameter as the blocking portion 25*b* becomes farther away from the shaft portion 25*a*. The diameter of the bottom surface on the large diameter side of the blocking portion 25*b* is a predetermined dimension that is larger than the diameter of the shaft portion 25*a*.

Figure 8:
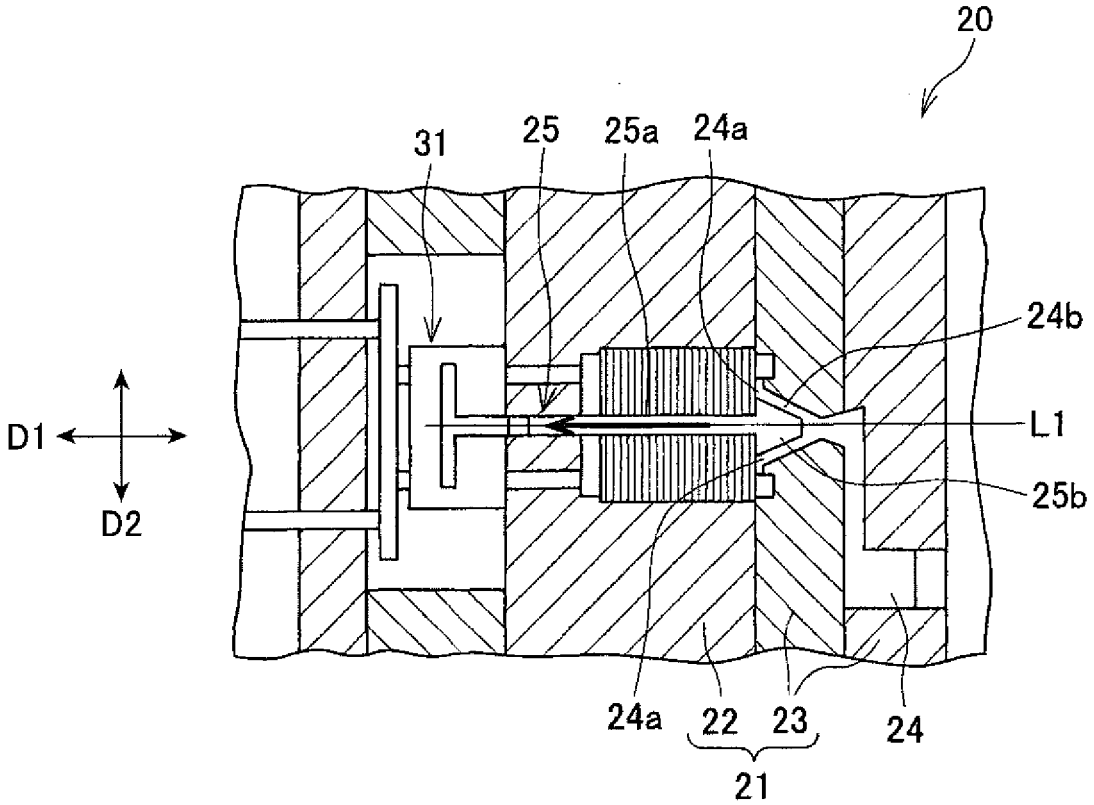
FIG. 8 is an explanatory diagram of a casting step in the method for manufacturing a rotor according to the first embodiment.

As shown in FIG. 8, the holding pin 25 is set together with the plurality of steel plates 11*a* in the cavity 22*a* of the fixed mold 22. The end portion of the holding pin 25 on the opposite side of the blocking portion 25*b* is connected to a driving unit 31. The driving unit 31 is configured by an air cylinder or the like. The holding pin 25 is thereafter pulled towards the left side in FIG. 8 by the driving unit 31.

As a result, the bottom surface of the blocking portion 25*b* on the large diameter side comes into contact with the one direction end of the steel plates 11*a*. The opening of the center shaft hole 12 on the molten metal feeding side is blocked. Inflow of molten metal into the center shaft hole 12 is prevented. The holding pin 25 and the driving unit 31 are connected by, for example, connection methods described in third to fifth variation examples, described hereafter.

The blocking portion 25*b* is fitted into the sloped passage 24*b* of the movable mold 23 when the mold 21 is closed. The mold 21 is closed by the fixed mold 22 and the movable mold 23 being moved so as to approach each other in the axial direction D1.

As a result, the cylindrical sloped passage 24*b* is formed between the outer peripheral wall of the sloped passage 24*b* and the outer peripheral surface of the blocking portion 25*b*. The sloped passage 24*b* is sloped so as to gradually increase in diameter towards the gate 24*a* side. The slope angle of the outer peripheral wall surface of the sloped passage 24*b* and the slope angle of the outer peripheral surface of the blocking portion 25*b* in relation to a center axial line L1 of the shaft portion 25*a* are substantially the same.

Therefore, the sloped passage 24*b* is formed into a cylindrical shape having a substantially fixed thickness. The ring shaped gate 24*a* is formed in the end portion of the sloped passage 24*b* on the large diameter side. The gate 24*a* makes a single continuous circuit in the circumferential direction D3. In other words, the inner peripheral surface side of the sloped passage 24*b* is partitioned by the outer peripheral surface of the blocking portion 25*b*.

Figure 9:
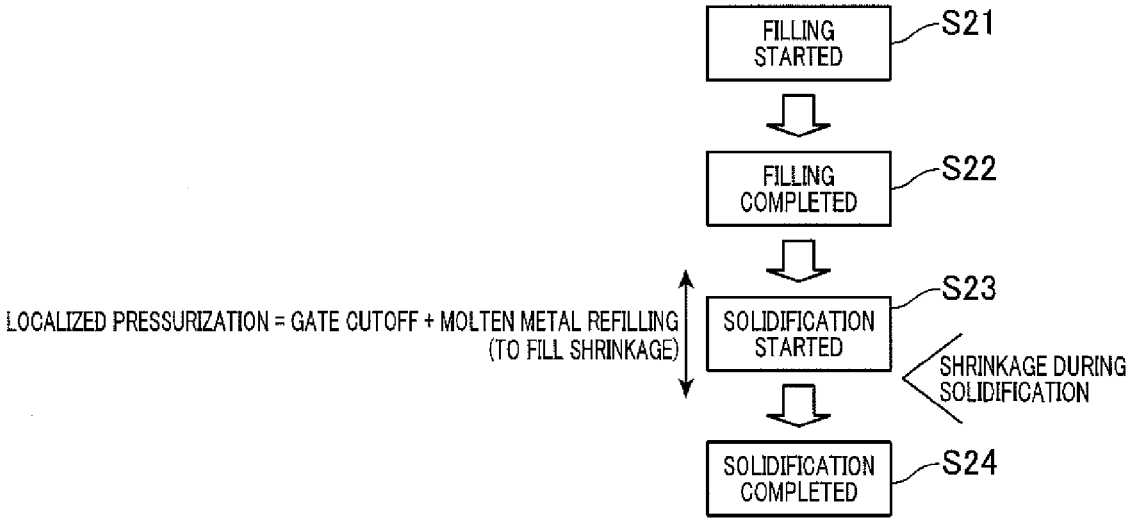
FIG. 9 is a flowchart of the casting step in the method for manufacturing a rotor according to the first embodiment.
Figure 10:
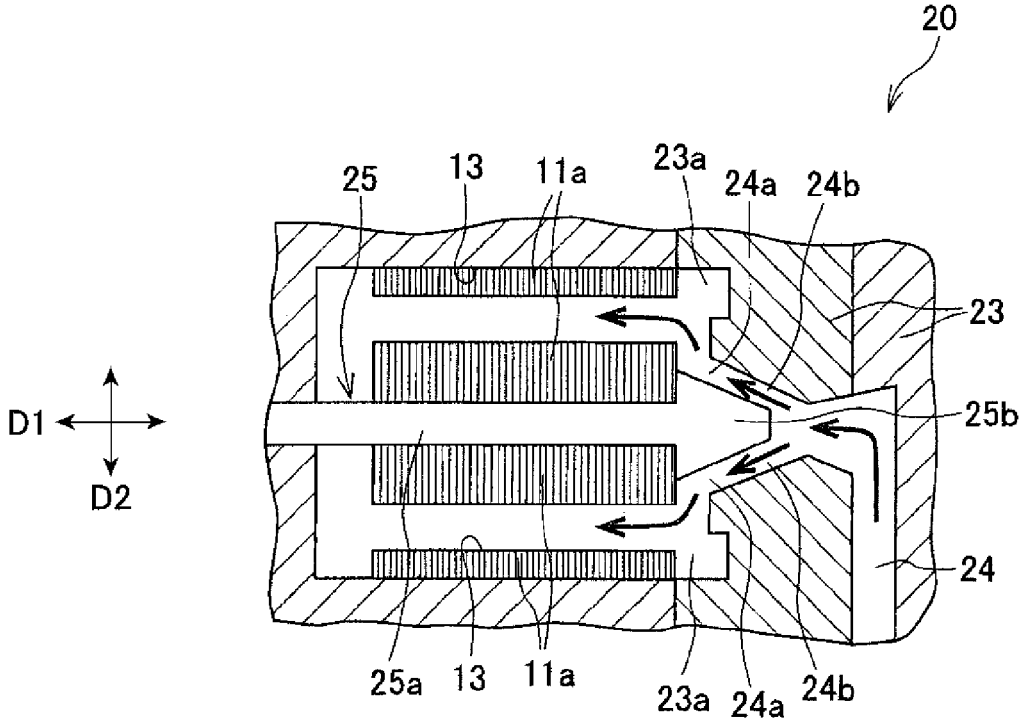
FIG. 10 is an explanatory diagram of the flow of molten metal in an axial direction from a gate at the casting step in the method for manufacturing a rotor according to the first embodiment.

From the state after completion of the setting step S10 shown in FIG. 6, the subsequent casting step S20 is performed based on the flowchart shown in FIG. 9. In other words, molten aluminum is injected into the molten metal introduction passage 24 in the mold 21 under predetermined pressure, and then, filling is started (step S21). At this time, as shown in FIG. 10, the molten metal that has been injected into the molten metal introduction passage 24 flows through the sloped passage 24*b*. The molten metal then flows from the gate 24*a* into the cavity 23*a* of the movable mold 23.

Figure 11:
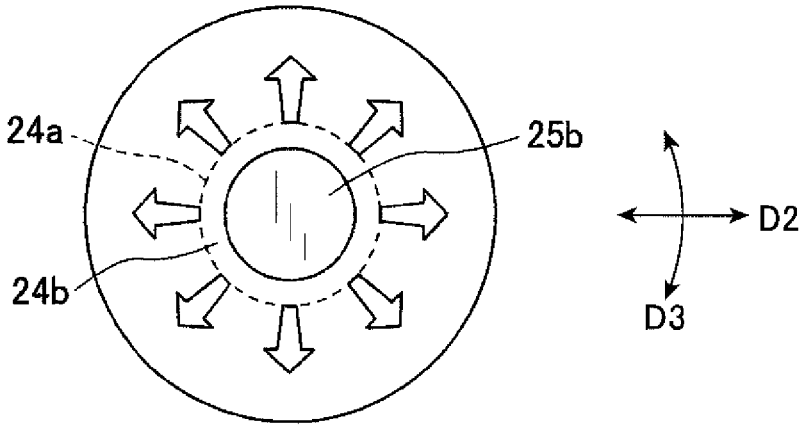
FIG. 11 is an explanatory diagram of the flow of molten metal in a radial direction from the gate at the casting step in the method for manufacturing a rotor according to the first embodiment.

According to the present embodiment, the sloped passage 24*b* is formed into a cylindrical shape that is sloped so as to gradually increase in diameter towards the gate 24*a*. The gate 24*a* is also formed into a ring shape. Therefore, as shown in FIG. 11, the molten metal that flows from the gate 24*a* into the cavity 23*a* flows evenly in a radiating direction (radial direction D2).

As shown in FIG. 10, the molten metal within the cavity 23*a* then flows through each through hole 13 in the stacked steel plates 11*a* into the cavity 22*a* of the fixed mold 22. As a result, the molten metal fills each through hole 13 and the interior of both cavities 22*a* and 23*a*. In this state, filling is completed (step S22). Then, when the molten metal filling the through holes 13 and the cavities 22*a* and 23*a* starts to solidify (step S23), shrinkage occurs with temperature decrease. Therefore, the through holes 13 and the cavities 22*a* and 23*a* are refilled with molten metal, and then, solidification of the filled molten metal is completed (step S24). After the elapse of a predetermined amount of time, the subsequent cutoff step S30 is performed.

Figure 12:
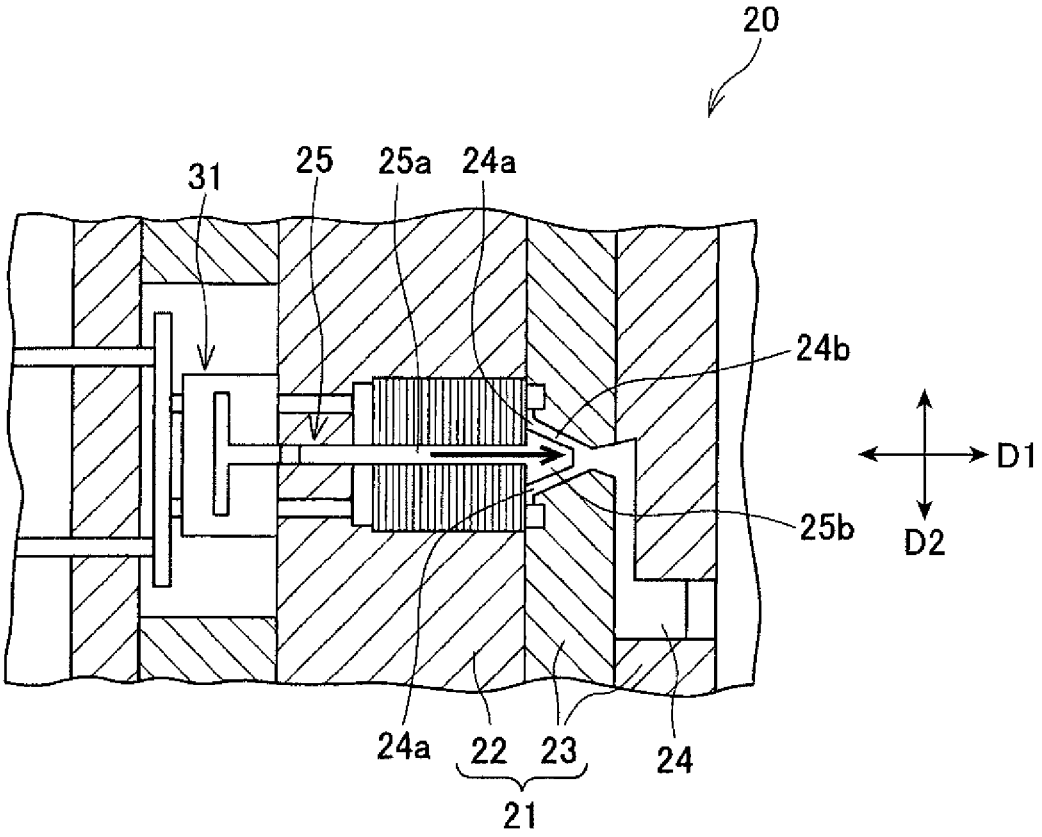
FIG. 12 is an explanatory diagram of a state immediately before a cutoff step in the method for manufacturing a rotor according to the first embodiment.
Figure 13:
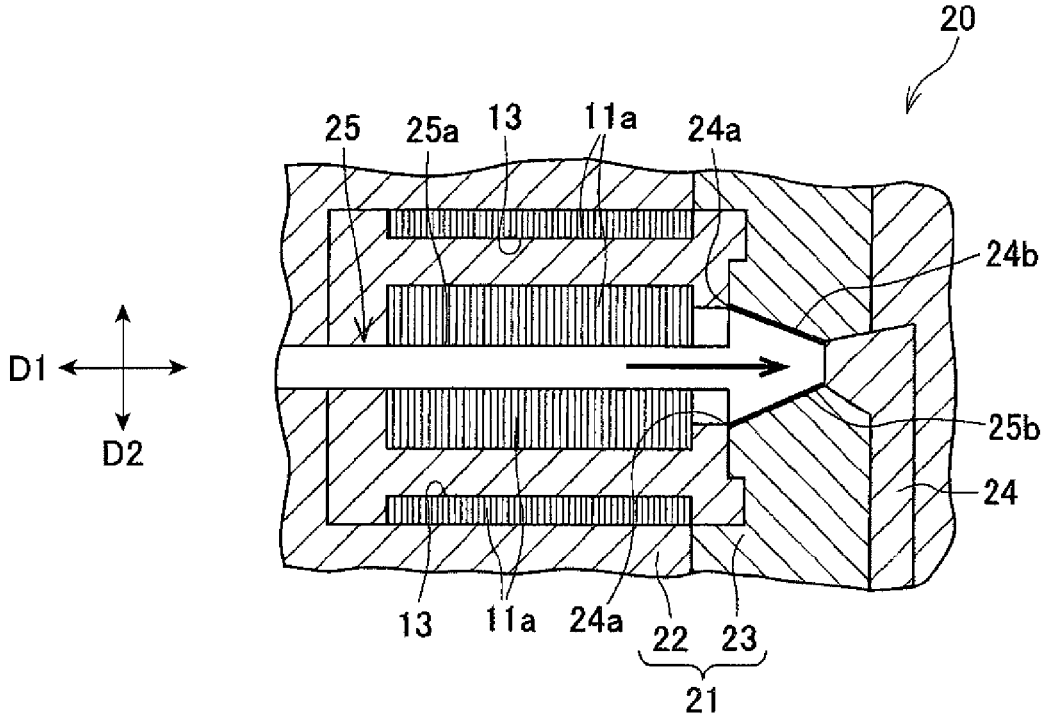
FIG. 13 is an explanatory diagram of the cutoff step in the method for manufacturing a rotor according to the first embodiment.

As shown in FIG. 12, at the cutoff step S30, the driving unit 31 moves the holding pin 25 towards the blocking portion 25*b* side (the right side in FIG. 12). The molten metal in the sloped passage 24*b* is locally pressurized. As a result, as shown in FIG. 13, the outer peripheral wall of the blocking portion 25*b* of the holding pin 25 comes into contact with the outer peripheral wall surface of the sloped passage 24*b*. The molten metal within the sloped passage 24*b* is cut off, and separated into the gate 24*a* side and the molten metal introduction opening side. As a result, casting defects accompanying solidification shrinkage of the molten metal are prevented from occurring. At the same time, cut-off of the molten metal near the gate 24*a* of the sloped passage 24*b* is facilitated.

Figure 14:
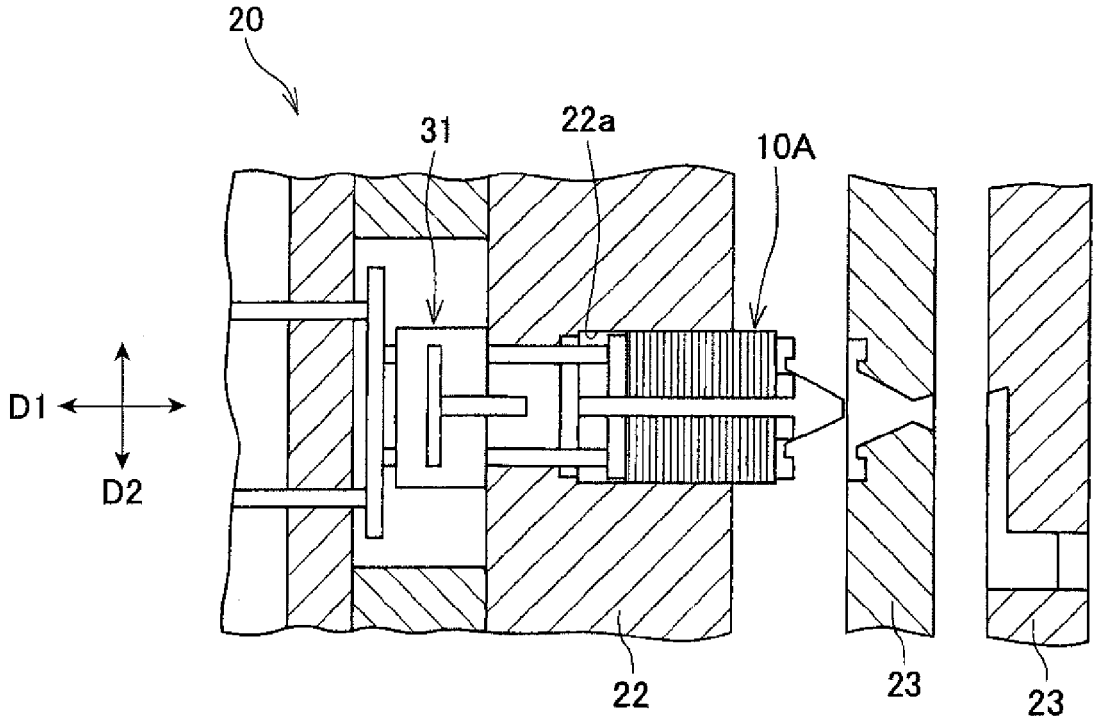
FIG. 14 is an explanatory diagram of a mold-releasing step in the method for manufacturing a rotor according to the first embodiment.

After the cutoff step S30 is completed and solidification of the molten metal is completed, the subsequent mold-releasing step S40 is performed. As shown in FIG. 14, a driving unit (not shown) relatively moves the movable mold 23 so as to separate from the fixed mold 22 in the axial direction D1 (towards the right side in FIG. 14). The mold 21 is thereby opened. In this state, a casting 10A (rotor 10) is removed from the cavity 22*a* of the fixed mold 22. The holding pin 25 is pulled out and removed. The mold-releasing step S40 is completed. Thereafter, post-processing, such as deburring, is performed as required. All steps are then completed. The rotor 10 that is the product shown in FIG. 2 to FIG. 5 is thereby completed.

As described above, in the method for manufacturing the rotor 10 according to the present embodiment, the mold 21 that is used at the casting step S20 is provided with the molten metal introduction passage 24. The molten metal introduction passage 24 has the ring-shaped gate 24*a*. The gate 24*a* opens so as to oppose the one axial end surface of the plurality of steel plates 11*a* set in the mold 21. As a result, the molten metal can be sent into the cavity of a mold in a well-balanced manner, so as to flow evenly in the circumferential direction D3. Therefore, fluidity of the molten metal becomes favorable. The occurrence of casting defects, such as blowholes, can be suppressed.

In addition, according to the present embodiment, the molten metal introduction passage 24 has the cylindrical sloped passage 24*b*. The sloped passage 24*b* is sloped so as to gradually increase in diameter towards the gate 24*a*. As a result, the molten metal that is fed into the molten metal introduction passage 24 can be smoothly sent from the sloped passage 24*b* towards the gate 24*a* so as to flow evenly in the circumferential direction D3.

In addition, according to the present embodiment, at the setting step S10, the plurality of steel plates 11*a* that are set in the mold 21 are held by the holding pin 25. The holding pin 25 includes the shaft portion 25*a* and the blocking portion 25*b*. The shaft portion 25*a* is inserted into the center shaft hole 12. The blocking portion 25*b* is provided in the one axial end portion of the shaft portion 25*a*. The blocking portion 25*b* blocks the opening of the center shaft hole 12 on the molten metal feeding side.

Therefore, risk of the plurality of steel plates 11*a* set in the mold 21 becoming separated by pressure from the molten metal can be prevented. In addition, the blocking portion 25*b* can prevent the molten metal from flowing into the center shaft hole 12 of the plurality of steel plates 11*a*. As a result, occurrence of defective products and reduced dimensional accuracy can be prevented.

In addition, the holding pin 25 according to the present embodiment has the engaging projecting portion 26*b* (positioning portion). The engaging projecting portion 26*b* performs positioning in the rotation direction of the plurality of steel plates 11*a* fitted onto the shaft portion 25*a*. Therefore, when the stacked plurality of steel plates 11*a* are set in the mold 21, the rotation-direction positions of the mold 21, the plurality of steel plates 11*a*, and the holding pin 25 can be clarified. As a result, occurrence of defective products and reduced dimensional accuracy can be prevented with further certainty.

In addition, according to the present embodiment, at the cutoff step S30, the molten metal is cut off as a result of the driving unit 31 moving the holding pin 25 in the axial direction D1. The blocking portion 25*b* thereby comes into contact with the outer peripheral wall surface of the sloped passage 24*b*. As a result, the cutoff step S30 can be simply and easily performed using the holding pin 25.

Other Embodiments

The present disclosure is not limited to the above-described embodiment. Various modifications are possible without departing from the scope of the present disclosure. Hereafter, these modifications are described in detail by first to ninth variation examples. Components and sections in the first to ninth variation examples that are common to the first embodiment are given the same reference numbers.

First Variation Example

The holding pin 25 according to the first embodiment is configured so that the slope angle of the outer peripheral surface of the blocking portion 25*b* and the slope angle of the outer peripheral wall surface of the sloped passage 24*b* in relation to the center axial line L1 of the shaft portion 25*a* are substantially the same. The molten metal is cut off by the overall outer peripheral surface of the blocking portion 25*b* coming into contact with the outer peripheral wall surface of the sloped passage 24*b*.

Figure 15:
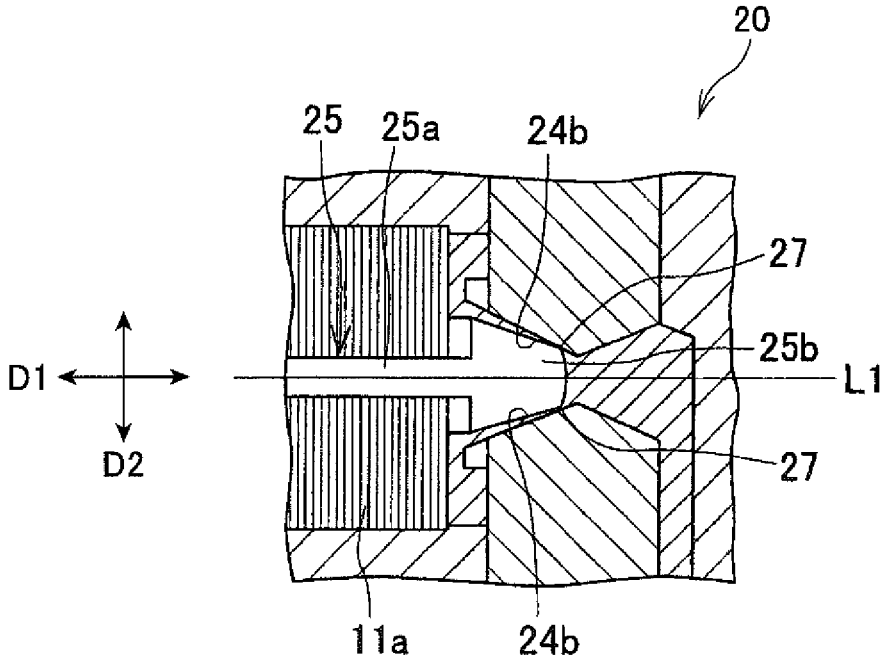
FIG. 15 is an explanatory diagram of a cutoff state by a cutoff portion of the holding pin in a first variation example.

Instead of this configuration, as in a first variation example shown in FIG. 15, a cutoff portion 27 may be disposed on an opposing surface of the blocking portion 25*b* that opposes the outer peripheral wall surface of the sloped passage 24*b*. The cutoff portion 27 is formed by a corner portion at which two surfaces, i.e., an outer peripheral surface and a tip surface of the blocking portion 25*b* meet (intersect).

In the cutoff portion 27 in this instance, the slope angle of the outer peripheral surface of the blocking portion 25*b* in relation to the center axial line L1 is smaller than the slope angle of the outer peripheral wall surface of the sloped passage 24*b* in relation to the center axial line L1. Therefore, the cutoff portion 27 is formed by the corner portion in which the outer peripheral surface and the tip surface of the blocking portion 25*b* meet.

In the first variation example, a shape is formed that facilitates the application of localized stress on the outer peripheral wall surface of the sloped passage 24*b*. Therefore, cut-off of the molten metal within the sloped passage 24*b* can be easily performed with certainty.

Second Variation Example

Figure 16:
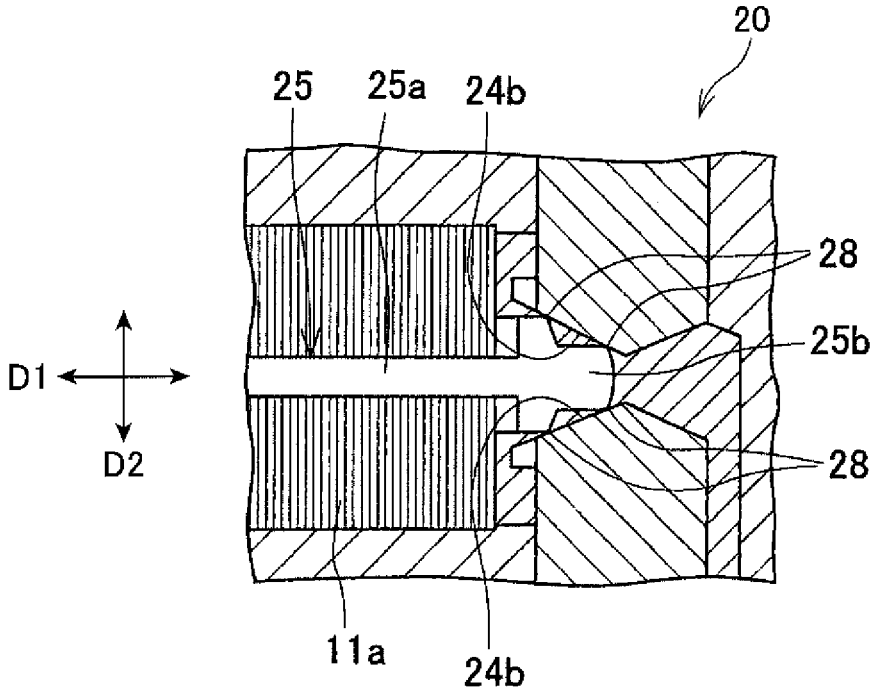
FIG. 16 is an explanatory diagram of a cutoff state by the cutoff portion of the holding pin in a second variation example.

Instead of the above-described first variation example, cutting portions 28 may be provided in two locations of the blocking portion 25*b*, as in a second variation example shown in FIG. 16. In this instance, the blocking portion 25*b* is formed into a two-step columnar shape composed of a large diameter portion and a small diameter portion. One cutoff portion 28 is formed by a corner portion in which the outer peripheral surface of the large diameter portion and a ring-shaped plane of a stepped portion meet. The other cutoff portion 28 is formed by a corner portion in which the outer peripheral surface of the small diameter portion and the tip surface of the blocking portion 25*b* meet.

In the second variation example, the cutoff portions 28 are formed in two locations on the outer peripheral surface of the blocking portion 25*b*. Therefore, compared to the first variation example, cut-off of the molten metal within the sloped passage 24*b* can be more easily performed with further certainty.

Third Variation Example

Figure 17A:
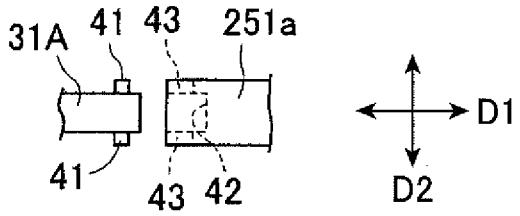
FIGS. 17A to 17F are explanatory diagrams of a method for connecting the holding pin and a driving unit in a third variation example.
Figure 17B:
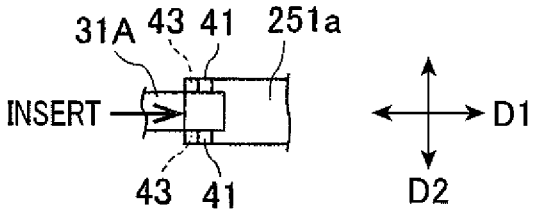
Figure 17C:
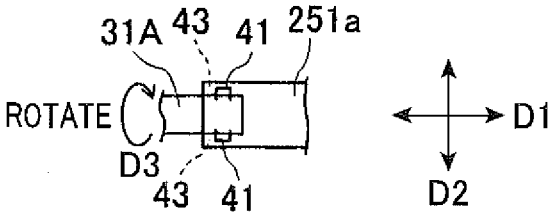
Figure 17D:
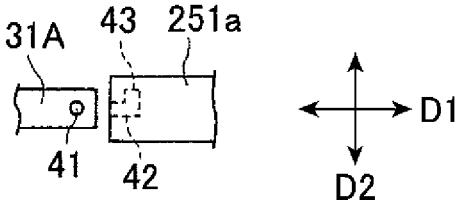
Figure 17E:
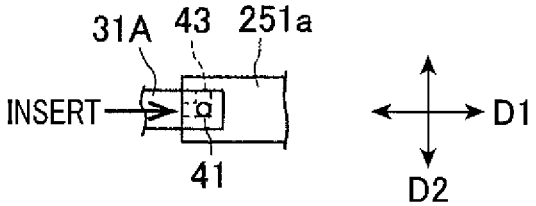
Figure 17F:
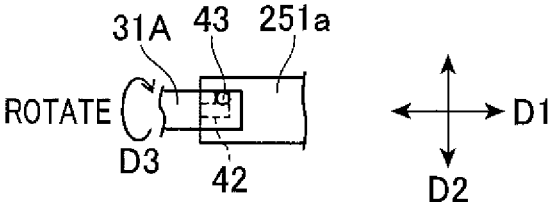

As shown in FIGS. 17A to 17F, a third variation example is an example of a connection method for connecting the holding pin 25 and the driving unit 31 in the above-described first embodiment. A lock mechanism actualized by rotation is used. FIGS. 17D to 17F show the state at a position shifted by about 90° in the circumferential direction D3 in relation to the position in FIGS. 17A to 17C.

In this instance, a pair of engaging protrusions 41 are provided in the one axial end portion (the right end portion in FIGS. 17A to 17F) of a cylinder rod 31A of the driving unit 31. The pair of engaging protrusions 41 are provided in positions on the outer peripheral surface that are phase-shifted by 180°.

Meanwhile, an insertion hole 42 and a pair of engaging grooves 43 are provided in the end portion on the opposite side of the blocking portion 25*b* (the left end portion in FIGS. 17A to 17F) of a shaft portion 251*a* of the holding pin 25. The one axial end portion of the cylinder rod 31A is inserted into the insertion hole 42. The pair of engaging protrusions 41 engage with the pair of engaging grooves 43. The insertion hole 42 opens onto the end surface on the opposite side of the blocking portion 25*b* of the shaft portion 251*a* and extends in the axial direction D1.

In addition, the engaging groove 43 is formed so as to bend at a right angle in the circumferential direction D3 after extending for a predetermined distance in the axial direction D1 from the end surface on the opposite side of the blocking portion 25*b* of the shaft portion 251*a*.

The connection operation in the third variation example is performed as follows. First, as shown in FIGS. 17A and 17D, the shaft portion 251*a* of the holding pin 25 and the cylinder rod 31A are disposed in a state in which the respective axial end surfaces oppose each other in the axial direction D1.

At this time, positioning of the engaging protrusions 41 of the cylinder rod 31A and the engaging grooves 43 of the shaft portion 251*a* is performed. From this state, as shown in FIGS. 17B and 17E, the tip of the cylinder rod 31A is relatively moved in the axial direction D1 and inserted into the insertion hole 42 of the shaft portion 251*a*.

Then, after the engaging protrusions 41 reach the innermost end of the engaging grooves 43, as shown in FIGS. 17C and 17F, the cylinder rod 31A is relatively rotated in the circumferential direction D3. As a result, the engaging protrusions 41 are engaged with the engaging grooves 43 that extend in the circumferential direction D3.

The cylinder rod 31A and the shaft portion 251*a* are connected in a state in which relative movement in the axial direction D1 is restricted.

In the connection method of the third variation example, the lock mechanism actualized by rotation is used. Therefore, the cylinder rod 31A and the shaft portion 251*a* can be connected with certainty by a simple and easy operation.

Fourth Variation Example

Figure 18A:
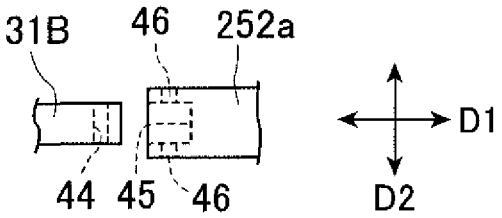
FIGS. 18A to 18C are explanatory diagrams of a method for connecting the holding pin and the driving unit in a fourth variation example.
Figure 18B:
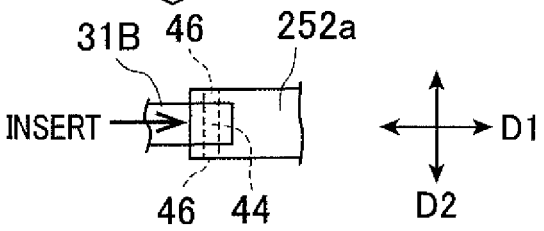
Figure 18C:
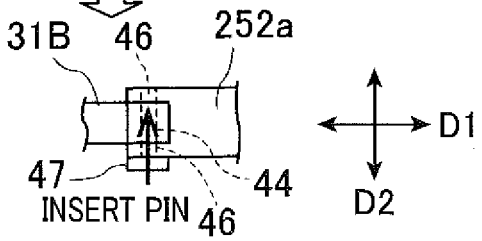

A fourth variation example is an example of another connection method for connecting the holding pin 25 and the driving unit 31 in the above-described first embodiment. In the fourth variation example, as shown in FIGS. 18A to 18C, instead of the lock mechanism actualized by rotation that is used in above-described third variation example, a lock mechanism actualized by an insertion pin 47 is used.

In this instance, a first pin hole 44 is provided in a predetermined position on the one axial end portion (the right end portion in FIGS. 18A to 18C) of a cylinder rod 31B of the driving unit 31. An insertion pin 47 is inserted into the first pin hole 44. The first pin hole 44 is formed so as to pass through the cylinder rod 31B in the radial direction D2. The first pin hole 44 intersects with a center axial line of the cylinder rod 31B at a right angle.

Meanwhile, an insertion hole 45 and a second pin hole 46 are provided in the end portion on the opposite side of the blocking portion 25*b* (the left end portion in FIGS. 18A to 18C) of a shaft portion 252*a* of the holding pin 25. The one axial end portion of the cylinder rod 31B is inserted into the insertion hole 45. The second pin hole 46 is provided in a position on an extension line of the first pin hole 44 provided in the cylinder rod 31B when the cylinder rod 31B is inserted into the insertion hole 45.

The connection operation in the fourth variation example is performed as follows. First, as shown in FIG. 18A, the shaft portion 252*a* of the holding pin 25 and the cylinder rod 31B are disposed in a state in which the respective axial end surfaces oppose each other in the axial direction D1.

At this time, positioning of the first pin hole 44 of the cylinder rod 31B and the second pin hole 46 of the shaft portion 252*a* is performed. From this state, as shown in FIG. 18B, the tip portion of the cylinder rod 31B is relatively moved in the axial direction D1 and inserted into the insertion hole 45 of the shaft section 252*a*.

At this time, the tip of the cylinder rod 31B reaches the innermost end of the insertion hole 45. The first pin hole 44 and the second pin hole 46 overlap in the radial direction D2. In this state, as shown in FIG. 18C, the insertion pin 47 is inserted into the first pin hole 44 and the second pin hole 46. The connection operation is thereby completed.

In the connection method of the fourth variation example, the lock mechanism actualized by the insertion pin 47 is used. Therefore, compared to the third variation example, the cylinder rod 31B and the shaft portion 252*a* can be connected with more certainty by a simple and easy operation.

Fifth Variation Example

Figure 19A:
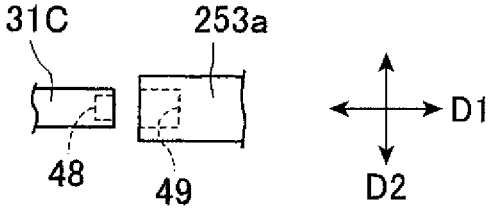
FIGS. 19A to 19C are explanatory diagrams of a method for connecting the holding pin and the driving unit in a fifth variation example.
Figure 19B:
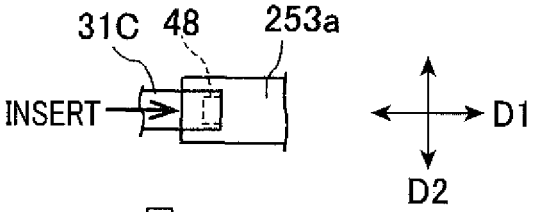

A fifth variation example is an example of still another connection method for connecting the holding pin 25 and the driving unit 31. In the fifth variation example, as shown in FIGS. 19A to 19C, instead of the lock mechanism actualized by rotation used in the above-described third variation example, a lock mechanism actualized by a magnet is used.

In this instance, a cylinder rod 31C of the driving unit 31 and a shaft portion 253*a* of the holding pin 25 are composed of a magnetic material, such as an iron-based metal. A permanent magnet 48 is embedded and fixed in a magnet housing hole in the one axial end portion (the right end portion in FIGS. 19A to 19C) of the cylinder rod 31C. The magnet housing hole is open on the axial end. Meanwhile, an insertion hole 49 is provided in the end portion on the opposite side of the blocking portion 25*b* (the left end portion in FIGS. 19A to 19C) of the shaft portion 253*a* of the holding pin 25. The one axial end portion of the cylinder rod 31C is inserted into the insertion hole 49.

The connection operation in the fifth variation example is performed as follows. First, as shown in FIG. 19A, the shaft portion 253*a* of the holding pin 25 and the cylinder rod 31C are disposed in a state in which the respective axial end surfaces oppose each other in the axial direction D1. From this state, as shown in FIG. 19B, the tip portion of the cylinder rod 31C is relatively moved in the axial direction D1 and inserted into the insertion hole 49 of the shaft portion 253*a*.

Figure 19C:
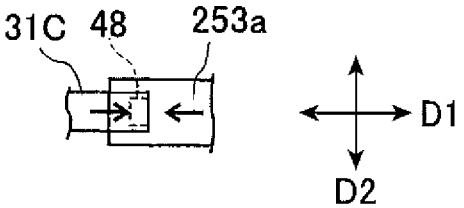

As a result, as shown in FIG. 19C, the cylinder rod 31C and the shaft portion 253*a* are firmly connected by the attraction force of the permanent magnet 48 embedded in the tip portion of the cylinder rod 31C. The connection operation is thereby completed.

In the connection method of the fifth variation example, the lock mechanism actualized by a magnet is used. Therefore, the cylinder rod 31C and the shaft portion 253*a* can be connected with certainty by a very simple and easy operation.

Sixth Variation Example

Figure 20:
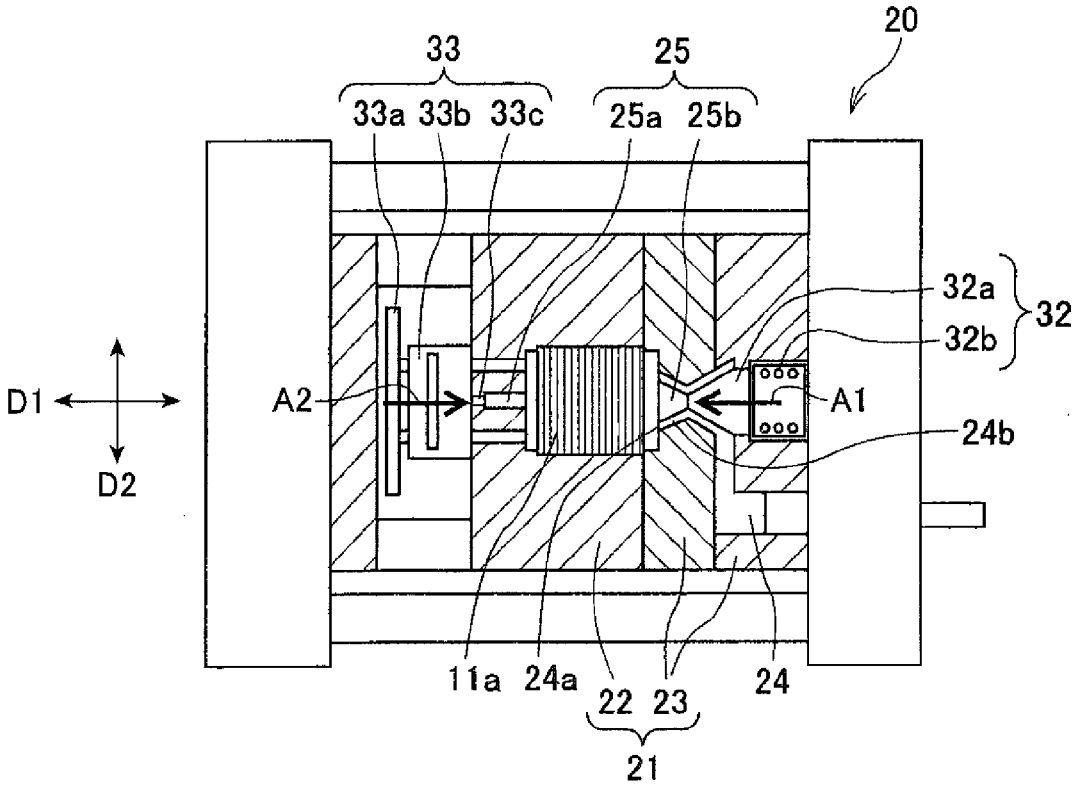
FIG. 20 is a schematic cross-sectional view of a casting apparatus that includes a driving mechanism of the holding pin in a sixth variation example.

A sixth variation example is a manufacturing method for manufacturing the rotor 10 using a casting apparatus shown in FIG. 20. In a manner similar to that according to the first embodiment, the manufacturing method is performed based on the flowchart in FIG. 1. The casting apparatus used in the sixth variation example includes the mold 21, an energizing member 32, and a pressing member 33. The mold 21 includes the fixed mold 22 and the movable mold 23.

In the sixth variation example as well, at the setting step S10, in a manner similar to that according to the first embodiment, the plurality of steel plates 11*a* that are set in the mold 21 are held by the holding pin 25. The holding pin 25 includes the shaft portion 25*a* and the blocking portion 25*b*. The pressing member 33 presses and moves the holding pin 25 in the axial direction D1. However, the sixth variation example differs from the first embodiment in that the pressing member 33 is not directly connected and fixed to the holding pin 25. This difference will be described in detail hereafter.

In the sixth variation example, at the setting step S10, the holding pin 25 is set in a predetermined position in the fixed mold 22 in a state in which the plurality of steel plates 11*a* are held. After the mold 21 is closed, the holding pin 25 is capable of being pressed from both axial sides by the energizing member 32 disposed on the one axial end side (the right side in FIG. 20) and the pressing member 33 disposed on the other axial end side (the left side in FIG. 20).

The energizing member 32 is disposed on the molten metal introduction passage 24 in the movable mold 23. The energizing member 32 includes a movable body 32*a* and a coil spring 32*b*. The movable body 32*a* is disposed so as to be in contact with the blocking portion 25*b* of the holding pin 25. The movable body 32*a* can be moved in the axial direction D1. The coil spring 32*b* energizes the movable body 32*a* towards the other axial end side. The movable body 32*a* is energized towards the other axial end side (the direction of arrow A1 shown in FIG. 20) at all times by the energizing force of the coil spring 32*b*. The energizing member 32 presses the blocking portion 25*b* towards the other axial end side at all times using the movable body 32*a*.

As a result, the bottom surface of the blocking portion 25*b* is in contact with the end surface on the one axial end side of the plurality of steel plates 11*a* that are set in the mold 21. The opening on molten metal feeding side of the center shaft hole 12 is blocked by the blocking portion 25*b*. This blocked state is maintained at the casting step S20.

The pressing member 33 includes a driving unit 33*a* and an air cylinder 33*b*. The driving unit 33*a* is disposed on the other axial end side of the fixed mold 22. The air cylinder 33*b* is driven by the driving unit 33*a*. The air cylinder 33*b* is disposed in a state in which the shaft portion 25*a* of the holding pin 25 and a cylinder rod 33*c* oppose each other in the axial direction D1. The holding pin 25 holds the plurality of steel plates 11*a* and is set in the mold 21. In this instance, the tip of the cylinder rod 33*c* that advances and retracts in the axial direction D1 is not connected and fixed to the shaft portion 25*a* of the holding pin 25 by a fixing piece or the like.

At the cutoff step S30, the pressing member 33 advances the cylinder rod 33*c* using the driving unit 33*a* with a pressing force that is greater than the energizing force of the energizing member 32. The tip of the cylinder rod 33*c* thereby presses the axial end surface of the shaft portion 25*a*, and moves the holding pin 25 towards the one axial end side (the direction of arrow A2 shown in FIG. 20). As a result, the blocking portion 25*b* is placed in contact with the outer peripheral wall surface of the sloped passage 24*b*. The molten metal is thereby cut off.

When the cylinder rod 33*c* is subsequently retracted, the holding pin 25 is pressed towards the other axial end side by the energizing force of the energizing member 32. The blocking portion 25*b* returns to the initial position that is in contact with the end surface on the one axial end side of the steel plates 11*a*.

In the sixth example, the holding pin 25 is pressed at all times towards the other axial end side (the retracting side of the cylinder rod 33*c*; the direction of arrow A1 shown in FIG. 20) by the energizing member 32. Therefore, the cylinder rod 33*a* is not required to be connected and fixed to the shaft portion 25*a*.

As described above, in the sixth variation example, the holding pin 25 can be pressed from both axial sides by the energizing member 32 disposed on the one axial end side and the pressing member 33 disposed on the other axial end side. The energizing member 32 presses the blocking portion 25*b* of the holding pin 25 towards the other axial end side at all times.

Therefore, the cylinder rod 33*c* of the pressing member 33 that operates at the cutoff step S30 and the shaft portion 25*a* of the holding pin 25 are not required to be connected and fixed together. Therefore, a fixing piece can be eliminated.

Seventh Variation Example

Figure 21:
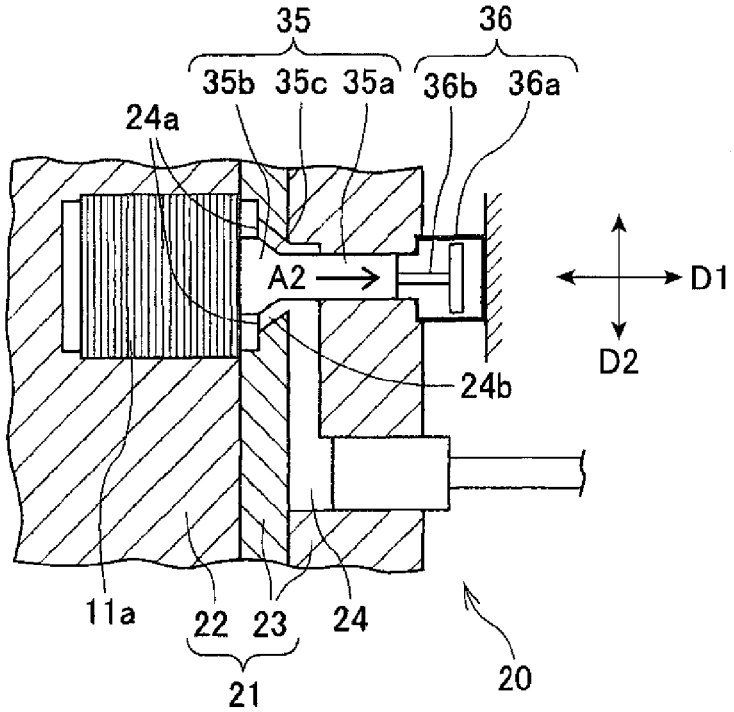
FIG. 21 is an explanatory diagram of the holding pin in a seventh variation example.

In a seventh variation example, instead of the holding pin 25 used in the above-described first embodiment, a blocking pin 35 is used to block the opening on the molten metal feeding side of the center shaft hole 12 of the plurality of steel plates 11*a* set in the mold 21, as shown in FIG. 21. The blocking pin 35 includes a passage partition surface 35*c* that partitions the inner peripheral surface of the sloped passage 24*b*.

The blocking pin 35 is composed of a shaft portion 35*a* and a circular truncated cone-shaped blocking portion 35*b*. The blocking portion 35*b* is provided integrally with one axial end portion (the left end portion in FIG. 21) of the shaft portion 35*a*. The blocking pin 35 is disposed on the molten metal introduction passage 24 in the movable mold 23. The blocking portion 25*b* is connected to the end surface on the one axial end side of the shaft portion 35*a* so that the end portion on the small diameter side is coaxial with the end surface.

At the setting step S10, the blocking pin 35 is disposed in a state in which the end surface on the one axial end side of the plurality of steel plates 11*a* set in the mold 21 oppose the bottom surface on the large diameter side of the blocking portion 35*b*. The blocking pin 35 is disposed so as to be coaxial with the plurality of steel plates 11*a*.

A driving unit 36 is disposed on the other axial end side (the right side in FIG. 21) of the blocking pin 35. The driving unit 36 includes an air cylinder 36*a* that moves the blocking pin 35 in the axial direction D1. The tip of a cylinder rod 36*b* of the air cylinder 36*a* is connected and fixed to the other axial end portion of the shaft portion 35*a* by a fixing piece (not shown).

Before the subsequent casting step S20 is started, the blocking pin 35 is pressed towards the one axial end side (the left side in FIG. 21; the direction of arrow A2) by the operation of the driving unit 36. The blocking pin 35 is placed in a state in which the bottom surface on the large diameter side of the blocking portion 35*b* is in contact with the end surface on the one axial end side of the plurality of steel plates 11*a* set in the mold 21 (see FIG. 21).

As a result, the opening on the molten metal feeding side of the center shaft hole 12 of the plurality of steel plates 11*a* is blocked. The outer peripheral surface of the blocking portion 35*b* serves as the passage partition surface 35*c* that partitions the inner peripheral surface of the sloped passage 24*b*.

Then, at the cutoff step S30 performed after completion of the casting step S20, the blocking pin 35 is pulled towards the other axial end side (the right side in FIG. 21) by the operation of the driving unit 36. The passage partition surface 35*c* of the blocking portion 35*b* comes into contact with the outer peripheral wall surface of the sloped passage 24*b*. The molten metal is thereby cut off.

As described above, in the seventh variation example, at the setting step S10, the plurality of steel plates 11*a* are set in the mold 21. The opening on the molten metal feeding side of the center shaft hole 12 of the steel plates 11*a* is blocked by the blocking pin 35. The blocking pin 35 has the passage partition surface 35*c* that partitions the inner peripheral surface of the sloped passage 24*b*. The blocking pin 35 is disposed so as to be in contact with the one axial end surface of the steel plates 11*a*.

As a result, inflow of molten metal into the center shaft hole 12 of the plurality of steel plates 11*a* set in the mold 21 can be reliably prevented using the blocking portion 35*b* of the blocking pin 35 that partitions the inner peripheral wall of the sloped passage 24*b*.

In addition, at the cutoff step S30, the driving unit 36 moves the blocking pin 35 in the axial direction D1. The passage partition surface 35*c* of the blocking portion 35*b* comes into contact with the outer peripheral wall surface of the sloped passage 24*b*. The molten metal is thereby cut off. As a result, the cutoff step S30 can be simply and easily performed using the blocking pin 35.

Eighth Variation Example

Figure 22:
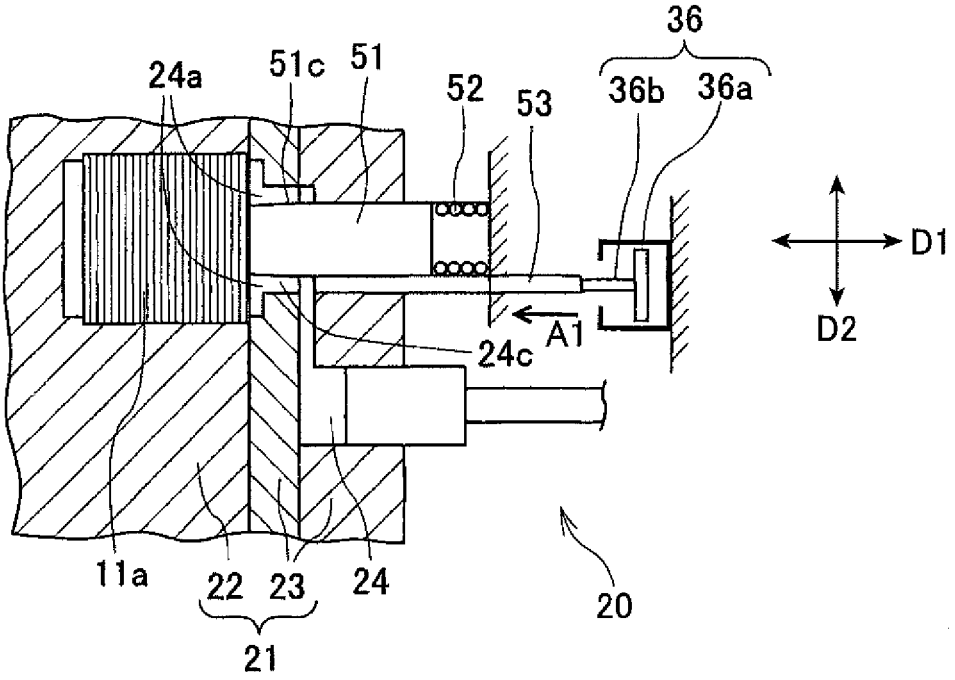
FIG. 22 is an explanatory diagram of the holding pin in an eighth variation example.

In an eighth variation example, instead of the blocking pin 35 used in the above-described seventh example, a blocking pin 51 is used to block the opening on the molten metal feeding side of the center shaft hole 12 of the plurality of steel plates 11*a* set in the mold 21, as shown in FIG. 22. The blocking pin 51 includes a passage partition surface 51*c* that partitions the inner peripheral surface of a cylindrical passage 24*c*.

Instead of the sloped passage 24*b* provided in the first embodiment and the like, the molten metal introduction passage 24 in the mold 21 in the eighth variation example is provided with a cylindrical passage 24*c*. The cylindrical passage 24*c* extends in the axial direction D1 with a substantially fixed diameter and communicates with the gate 24*a*.

The blocking pin 51 that is used in the eighth variation example is formed into a columnar shape. A tapered portion is formed in the one axial end portion (the left end portion in FIG. 22) of the blocking pin 51. The tapered portion decreases in diameter towards the one axial end side. At the setting step S10, the blocking pin 51 is disposed in a state in which the end surface on the one axial end side of the plurality of steel plates 11*a* set in the mold 21 oppose the end surface on the one axial end side (the tip surface of the tapered portion) of the blocking pin 51. The blocking pin 51 is disposed so as to be coaxial with the plurality of steel plates 11*a*.

A coil spring 52 is disposed on the other axial end side (the right side in FIG. 22) of the blocking pin 51. The coil spring 52 energizes the blocking pin towards the other axial end side (the direction of arrow A1 shown in FIG. 22) at all times. As a result, the end surface on the one axial end side (the tip surface of the tapered portion) of the blocking pin 51 is in contact with the end surface on the other axial end side of the plurality of steel plates 11*a* set in the mold 21. The opening on the molten metal feeding side of the center shaft hole 12 is blocked by the blocking pin 51.

In addition, the outer peripheral surface of the tapered portion of the blocking pin 51 serves as a passage partition surface 51*c* that partitions the inner peripheral surface of the cylindrical passage 24*c*. The blocked state is maintained at the casting step S20. The ring-shaped gate 24*a* that is formed in the periphery of the tapered portion of the blocking pin 51 increases in width in the radial direction D2 towards the one axial end side, because the one axial end side of the blocking pin 51 is tapered. Therefore, fluidity of the molten metal is improved.

A cutoff member 53 is disposed on the entrance side of the cylindrical passage 24*c*. The cutoff member 53 is formed into an elongated columnar shape. At the cutoff step S30, the cutoff member 53 cuts off the molten metal in the cylindrical passage 24*c*. The cutoff member 53 is disposed so as to be aligned in parallel with the blocking pin 51. The tip of the cutoff member 53 is positioned at the entrance of the cylindrical passage 24*c*. The driving unit 36 is disposed on the other axial end side of the cutoff member 53. The driving unit 36 includes the air cylinder 36*a* that moves the cutoff member 53 in the axial direction D1. The tip of a cylinder rod 36*b* of the air cylinder 36*a* is connected and fixed to the other axial end portion of the cutoff member 53 by a fixing piece (not shown). As a result, at the cutoff step S30, the cutoff member 53 is moved towards the one axial end side (the direction of arrow A1 shown in FIG. 22) by the operation of the driving unit 36. The molten metal in the cylindrical passage 24*c* is thereby cut off.

As described above, in the eighth example, the molten metal introduction passage 24 is provided with the cylindrical passage 24*c*. The cylindrical passage 24*c* communicates with the gate 24*a*. Therefore, the molten metal that is fed into the molten metal introduction passage 24 can be smoothly sent from the cylindrical passage 24*c* towards the gate 24*a* so as to be even in the circumferential direction D3.

In addition, at the setting step S10, the plurality of steel plates 11*a* are set in the mold 21. The opening on the molten metal feeding side of the center shaft hole 12 of the steel plates 11*a* is blocked by the blocking pin 51. The blocking pin 51 has the passage partition surface 51*c* that partitions the inner peripheral surface of the cylindrical passage 24*c*. The blocking pin 51 is disposed so as to be in contact with the one axial end surface of the steel plates 11*a*.

As a result, inflow of molten metal into the center shaft hole 12 of the plurality of steel plates 11*a* set in the mold 21 can be prevented with certainty using the blocking pin 51 that partitions the inner peripheral wall of the cylindrical passage 24*c*.

In addition, at the cutoff step S30, the driving unit 36 moves the cutoff member 53 in the axial direction D1. The molten metal in the cylindrical passage 24*c* is thereby cut off. As a result, the cutoff step S30 can be simply and easily performed using the cutoff member 53.

Ninth Variation Example

Figure 23:
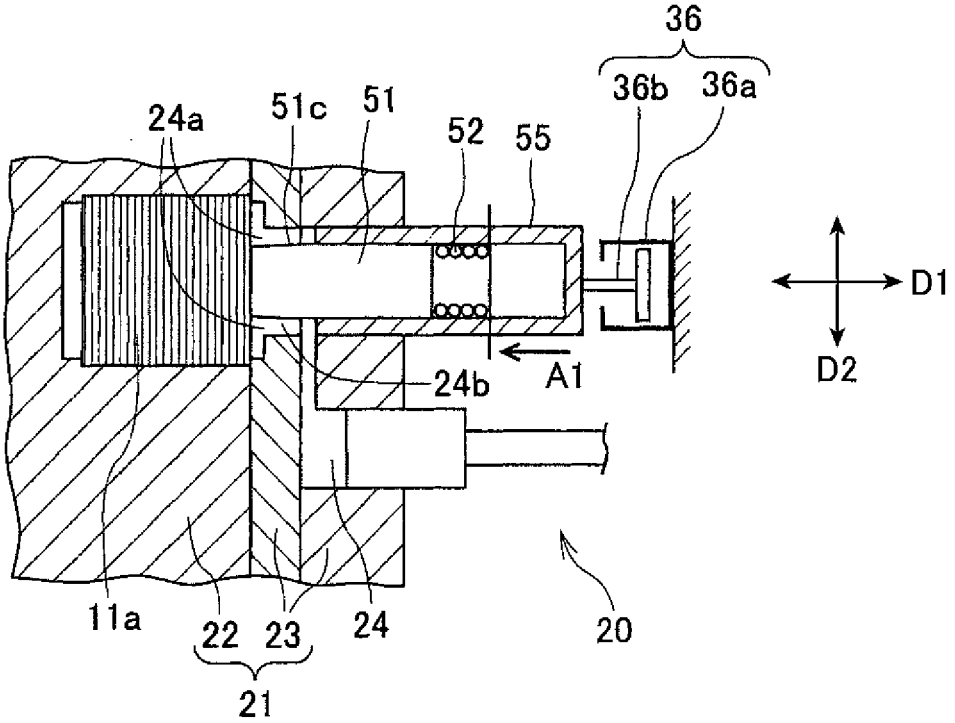
FIG. 23 is an explanatory diagram of the holding pin in a ninth variation example.
Figure 24:
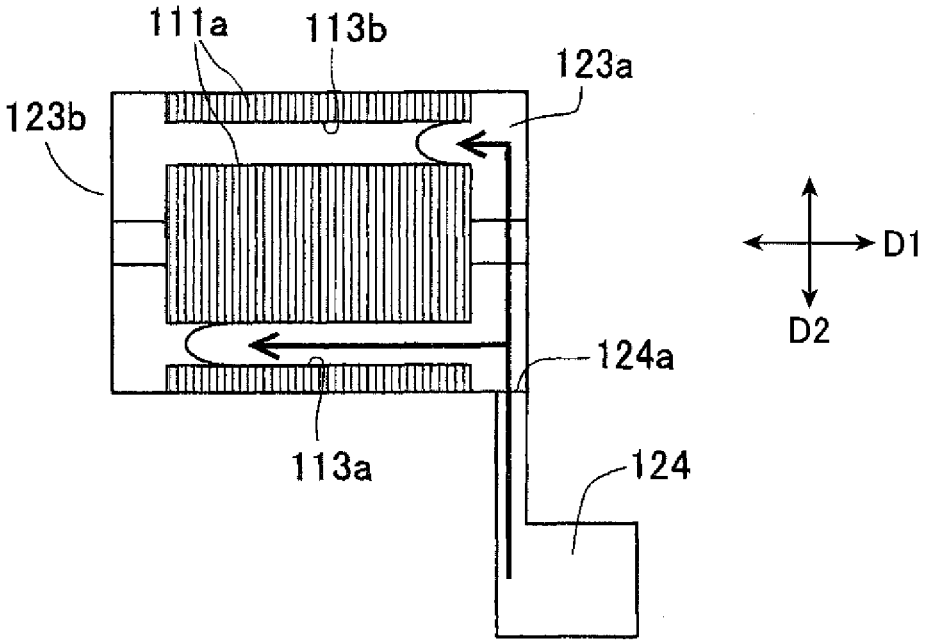
FIG. 24 is an explanatory diagram of a problem in a common conventional manufacturing method.
Figure 25:
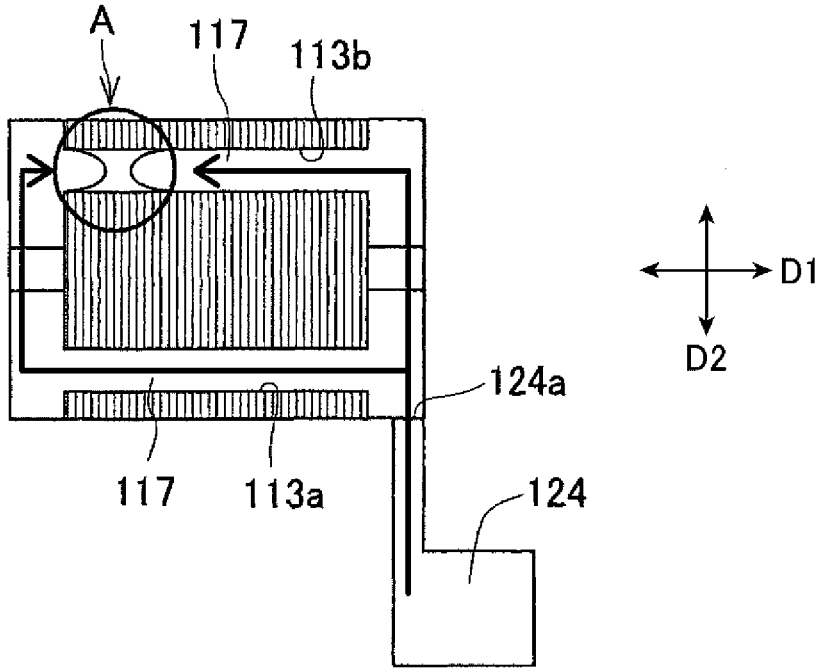
FIG. 25 is an explanatory diagram of another problem in the common conventional manufacturing method.

A ninth variation example differs from the above-described eighth variation example in that a cutoff member 55 is used instead of the cutoff member 53 used in the eighth variation example. As shown in FIG. 23, the cutoff member 55 has a cylindrical shape of which one end is open. The cutoff member 55 in the ninth variation example houses the rear end side (the right end side in FIG. 23) of the blocking pin 51 therein. The cutoff member 55 is disposed coaxially with the blocking pin 51 and is capable of relative movement in the axial direction D1. The end portion on the opening side (the left side in FIG. 23) of the cutoff member 55 is positioned at the entrance of the cylindrical passage 24*b*.

The driving unit 36 is disposed on the bottom portion side (the right side in FIG. 23) of the cutoff member 55. The driving unit 36 includes the air cylinder 36*a* that moves the cutoff member 55 in the axial direction D1. The tip of a cylinder rod 36*b* of the air cylinder 36*a* is connected and fixed to the other axial end portion of the cutoff member 55 by a fixing piece (not shown).

As a result, in the ninth variation example as well, the cutoff member 55 is moved towards the one axial end side (the direction of arrow A1 shown in FIG. 23) by the operation of the driving unit 36. The molten metal in the cylindrical passage 24*b* is thereby cut off. Other configurations in the ninth variation example are the same as those in the eighth variation example. These configurations are given the same reference numbers. Detailed description thereof is omitted.

The ninth variation example that is configured as described above achieves operations and effects similar to those of the eighth variation example.

What is claimed is:

1. A method for manufacturing a rotor, the rotor comprising:

a rotor core composed of a plurality of steel plates stacked in an axial direction of the rotor, each of the steel plates having a center shaft hole and a plurality of through holes, the center shaft hole passing through the steel plates in the axial direction, the plurality of through holes passing through the steel plates in the axial direction and being arrayed in a circumferential direction of the rotor; and a conductive member that includes a pair of end rings and a plurality of connection bars, the pair of end rings being disposed on both axial ends of the rotor core in the axial direction, the plurality of connection bars connecting the pair of end rings through the through holes, the conductive member being integrally formed by casting, the method comprising:

a setting step of setting, in a predetermined position in a mold, the plurality of steel plates configuring the rotor core stacked in the axial direction, the mold being capable of being opened and closed by relative movement in the axial direction;

a casting step of feeding molten metal into a molten metal introduction passage to form the conductive member, the molten metal introduction passage having a ring-shaped gate that is opened so as to oppose one axial end surface of the plurality of steel plates set in the mold;

a cutoff step of cutting off the molten metal in the molten metal introduction passage so as to be separated into a gate side and a molten metal introduction opening side; and a mold-releasing step of opening the mold such that a casting configuring the rotor is removed from the mold, wherein the molten metal introduction passage comprises a cylindrical sloped passage that is tapered so as to gradually increase in diameter towards the gate.

2. The method for manufacturing a rotor according to claim 1, wherein:

the setting step comprises holding the plurality of steel plates set in the mold by a holding pin that comprises:

a shaft portion that is inserted into the center shaft hole; and a blocking portion that is disposed on one axial end portion of the shaft portion and blocks an opening of the center shaft hole on a feeding side of the molten metal.

3. The method for manufacturing a rotor according to claim 2, wherein:

the holding pin comprises a positioning portion that performs positioning in a rotation direction of the plurality of steel plates fitted onto the shaft portion.

4. The method for manufacturing a rotor according to claim 2, wherein:

the cutoff step comprises cutting off the molten metal by moving the holding pin in the axial direction by a driving unit such that the blocking portion comes into contact with an outer peripheral wall surface of the sloped passage.

5. The method for manufacturing a rotor according to claim 3, wherein:

the cutoff step comprises cutting off the molten metal by moving the holding pin in the axial direction by a driving unit such that the blocking portion comes into contact with an outer peripheral wall surface of the sloped passage.

6. The method for manufacturing a rotor according to claim 4, wherein:

the blocking portion comprises a cutoff portion that is disposed on an opposing surface of the blocking portion that opposes the outer peripheral wall surface of the sloped passage, the cutoff portion being formed by a corner portion at which two surfaces intersect.

7. The method for manufacturing a rotor according to claim 5, wherein:

the blocking portion comprises a cutoff portion that is disposed on an opposing surface of the blocking portion that opposes the outer peripheral wall surface of the sloped passage, the cutoff portion being formed by a corner portion at which two surfaces intersect.

8. The method for manufacturing a rotor according to claim 2, wherein:

the holding pin is capable of being pressed from both axial sides by an energizing member disposed on one axial end side of the holding pin and a pressing member disposed on the other axial end side of the holding pin;

the casting step comprises pressing the blocking portion in the axial direction by an energizing force of the energizing member such that, in the plurality of steel plates set in the mold, the opening of the center shaft hole on the feeding side of the molten metal is blocked by the blocking portion; and the cutoff step comprises cutting off the molten metal by moving the holding pin in the axial direction by a pressing force of the pressing member such that the blocking portion comes into contact with an outer peripheral wall surface of the sloped passage.

9. The method for manufacturing a rotor according to claim 3, wherein:

the holding pin is capable of being pressed from both axial sides by an energizing member disposed on one axial end side of the holding pin and a pressing member disposed on the other axial end side of the holding pin;

the casting step comprises pressing the blocking portion in the axial direction by an energizing force of the energizing member such that, in the plurality of steel plates set in the mold, the opening of the center shaft hole on the feeding side of the molten metal is blocked by the blocking portion; and the cutoff step comprises cutting off the molten metal by moving the holding pin in the axial direction by a pressing force of the pressing member such that the blocking portion comes into contact with an outer peripheral wall surface of the sloped passage.

10. The method for manufacturing a rotor according to claim 4, wherein:

the holding pin is capable of being pressed from both axial sides by an energizing member disposed on one axial end side of the holding pin and a pressing member disposed on the other axial end side of the holding pin;

the casting step comprises pressing the blocking portion in the axial direction by an energizing force of the energizing member such that, in the plurality of steel plates set in the mold, the opening of the center shaft hole on the feeding side of the molten metal is blocked by the blocking portion; and the cutoff step comprises cutting off the molten metal by moving the holding pin in the axial direction by a pressing force of the pressing member such that the blocking portion comes into contact with an outer peripheral wall surface of the sloped passage.

11. The method for manufacturing a rotor according to claim 5, wherein:

the holding pin is capable of being pressed from both axial sides by an energizing member disposed on one axial end side of the holding pin and a pressing member disposed on the other axial end side of the holding pin;

the casting step comprises pressing the blocking portion in the axial direction by an energizing force of the energizing member such that, in the plurality of steel plates set in the mold, the opening of the center shaft hole on the feeding side of the molten metal is blocked by the blocking portion; and the cutoff step comprises cutting off the molten metal by moving the holding pin in the axial direction by a pressing force of the pressing member such that the blocking portion comes into contact with an outer peripheral wall surface of the sloped passage.

12. The method for manufacturing a rotor according to claim 6, wherein:

the holding pin is capable of being pressed from both axial sides by an energizing member disposed on one axial end side of the holding pin and a pressing member disposed on the other axial end side of the holding pin;

the casting step comprises pressing the blocking portion in the axial direction by an energizing force of the energizing member such that, in the plurality of steel plates set in the mold, the opening of the center shaft hole on the feeding side of the molten metal is blocked by the blocking portion; and the cutoff step comprises cutting off the molten metal by moving the holding pin in the axial direction by a pressing force of the pressing member such that the blocking portion comes into contact with an outer peripheral wall surface of the sloped passage.

13. The method for manufacturing a rotor according to claim 7, wherein:

the holding pin is capable of being pressed from both axial sides by an energizing member disposed on one axial end side of the holding pin and a pressing member disposed on the other axial end side of the holding pin;

the casting step comprises pressing the blocking portion in the axial direction by an energizing force of the energizing member such that, in the plurality of steel plates set in the mold, the opening of the center shaft hole on the feeding side of the molten metal is blocked by the blocking portion; and the cutoff step comprises cutting off the molten metal by moving the holding pin in the axial direction by a pressing force of the pressing member such that the blocking portion comes into contact with an outer peripheral wall surface of the sloped passage.

14. The method for manufacturing a rotor according to claim 1, wherein:

the setting step comprises blocking, in the plurality of steel plates set in the mold, the opening of the center shaft hole on the feeding side of the molten metal by a blocking pin that comprises a passage partition surface that is disposed so as to come into contact with one axial end surface of the plurality of steel plates and partitions an inner peripheral surface of the sloped passage.

15. The method for manufacturing a rotor according to claim 14, wherein:

the cutoff step comprises cutting off the molten metal by moving the blocking pin in the axial direction by a driving unit so as to come into contact with an outer peripheral wall surface of the sloped passage.

* * * * *